US008033869B1

(12) United States Patent
Zhu et al.

(10) Patent No.: US 8,033,869 B1
(45) Date of Patent: Oct. 11, 2011

(54) ELECTRICAL ADAPTOR HAVING OPPOSITE MATING PORTION WITH DIFFERENT TERMINAL PINS

(75) Inventors: Yu Zhu, Shenzhen (CN); Sheng-Ho Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/960,582

(22) Filed: Dec. 6, 2010

(30) Foreign Application Priority Data

Jul. 8, 2010 (CN) ..... 2010 2 0251900

(51) Int. Cl.
*H01R 24/00* (2011.01)

(52) U.S. Cl. ..... 439/660; 439/638

(58) Field of Classification Search ..... 439/660, 439/638, 78, 557, 82, 76.1
See application file for complete search history.

(56) References Cited

U.S. PATENT DOCUMENTS

| | | | | |
|---|---|---|---|---|
| 6,648,695 | B1 * | 11/2003 | Wu | 439/638 |
| 6,663,434 | B1 | 12/2003 | Wu | |
| 6,830,483 | B1 * | 12/2004 | Wu | 439/638 |
| 6,887,108 | B2 * | 5/2005 | Wu | 439/638 |
| 6,964,585 | B2 * | 11/2005 | Blichasz et al. | 439/638 |
| 7,789,710 | B2 * | 9/2010 | Chiang | 439/638 |
| 7,878,859 | B2 * | 2/2011 | Zhu | 439/638 |
| 7,914,302 | B1 * | 3/2011 | Zhu | 439/79 |
| 2009/0221161 | A1 * | 9/2009 | Zhu | 439/78 |
| 2010/0003857 | A1 * | 1/2010 | Zhu | 439/638 |

* cited by examiner

*Primary Examiner* — Tulsidas Patel
*Assistant Examiner* — Harshad Patel
(74) *Attorney, Agent, or Firm* — Wei Te Chung; Andrew C. Cheng; Ming Chieh Chang

(57) ABSTRACT

An electrical adaptor includes a first connector body loaded with first terminals and a second connector body loaded with second terminals. The two connector bodies assembly attaches with each other and each defines a mating port opposite to each other. At least partial of the first terminals each includes a contacting strip in the mating port of the first connector body and a touching portion. Each second terminal includes a contacting portion in the mating port of the second connector body and a touching portion. Each touching portion of the first terminals contacts with touching portions of two or more said second terminals.

15 Claims, 6 Drawing Sheets

| 22 Pin SATA Pin Definition | | |
|---|---|---|
| | TYPE | NAME |
| Signal Segment | GND | S1 |
| | A+ | S2 |
| | A- | S3 |
| | GND | S4 |
| | B- | S5 |
| | B+ | S6 |
| | GND | S7 |
| Power Segment | V3.3 | P1 |
| | V3.3 | P3 |
| | V3.3 | P3 |
| | GND | P4 |
| | GND | P5 |
| | GND | P6 |
| | V5 | P7 |
| | V5 | P8 |
| | V5 | P9 |
| | GND | P10 |
| | Always GND | P11 |
| | GND | P12 |
| | V12 | P13 |
| | V12 | P14 |
| | V12 | P15 |

| Micro SATA Pin Definition | | |
|---|---|---|
| NAME | TYPE | |
| S1 | GND | Signal Segment |
| S2 | A+ | |
| S3 | A- | |
| S4 | GND | |
| S5 | B- | |
| S6 | B+ | |
| S7 | GND | |
| P1 | V3.3 | Power Segment |
| P3 | V3.3 | |
| P3 | GND | |
| P4 | GND | |
| P5 | V5 | |
| P6 | V5 | |
| P7 | Always GND | |
| P8 | Undefined | |
| P9 | Undefined | |

FIG. 6

ELECTRICAL ADAPTOR HAVING OPPOSITE MATING PORTION WITH DIFFERENT TERMINAL PINS

BACKGROUND OF THE INVENTION

1. Field of the Invention

The present invention generally relates to an electrical adaptor with two opposite mating ports with different terminal pins.

2. Description of Related Art

A large number of connector interfaces are used in our lives for creating a data or power link between electrical devices, such as USB, HDMI, IEEE1394. However, different interfaces have different profile and contact numbers therein. Understandably, they cannot mate with each other directly. Many electrical adapters, thereby, are designed to electrically interconnect those different interface standard devices.

U.S. Pat. No. 6,887,108 issued to Jerry Wu on May. 3, 2005 just discloses an adapter for change between a SCA2 port and a SATA port. As changes between these two interfaces are complex, a convert circuit board is set for adapting them. In some improved applications, the convert circuit board can be leaved out when adapted interfaces have only a few differences. However, the insulating bases themselves still have some terminals that are strictly formed but will not be worked in adaptor, which causes redundant manufacturing structure and progress.

Hence, an improved electrical adapter is desired to overcome the disadvantages of the prior art.

BRIEF SUMMARY OF THE INVENTION

An object of the invention is to provide an electrical adaptor with simplified and advanced contact structure, thereby decreasing improve the manufacturing therebetween.

An electrical adaptor according to an embodiment of the present invention includes a first connector body loaded with first terminals and a second connector body loaded with second terminals. The two connector bodies assembly attaches with each other and each defines a mating port opposite to each other. At least partial of the first terminals each includes a contacting strip in the mating port of the first connector body and a touching portion. Each second terminal includes a contacting portion in the mating port of the second connector body and a touching portion. Each touching portion of the first terminals contacts with touching portions of two or more said second terminals.

Other objects, advantages and novel features of the invention will become more apparent from the following detailed description of the present embodiment when taken in conjunction with the accompanying drawings.

BRIEF DESCRIPTION OF THE DRAWINGS

FIG. 6 is a comparison of pin definition between standard 22 Pin SATA and Micro SATA.

DETAILED DESCRIPTION OF THE INVENTION

Figure 1:
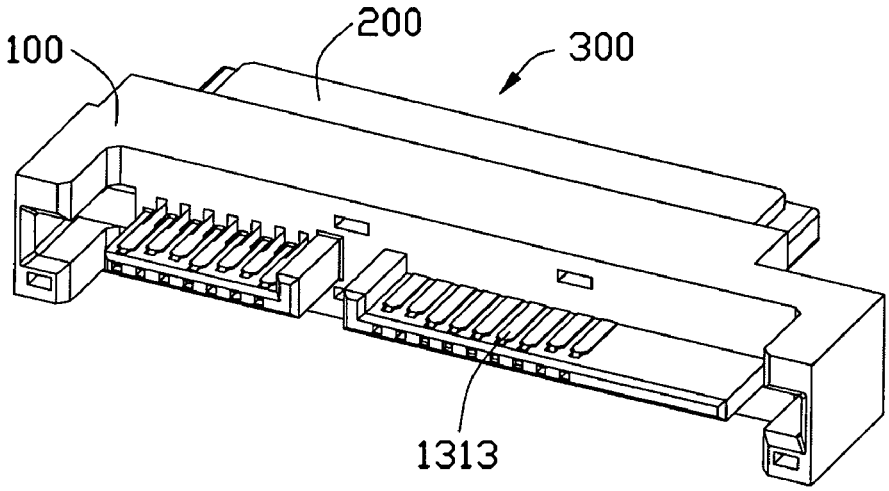
FIG. 1 is a perspective view of an electrical adaptor of an embodiment of the present invention.
Figure 2:
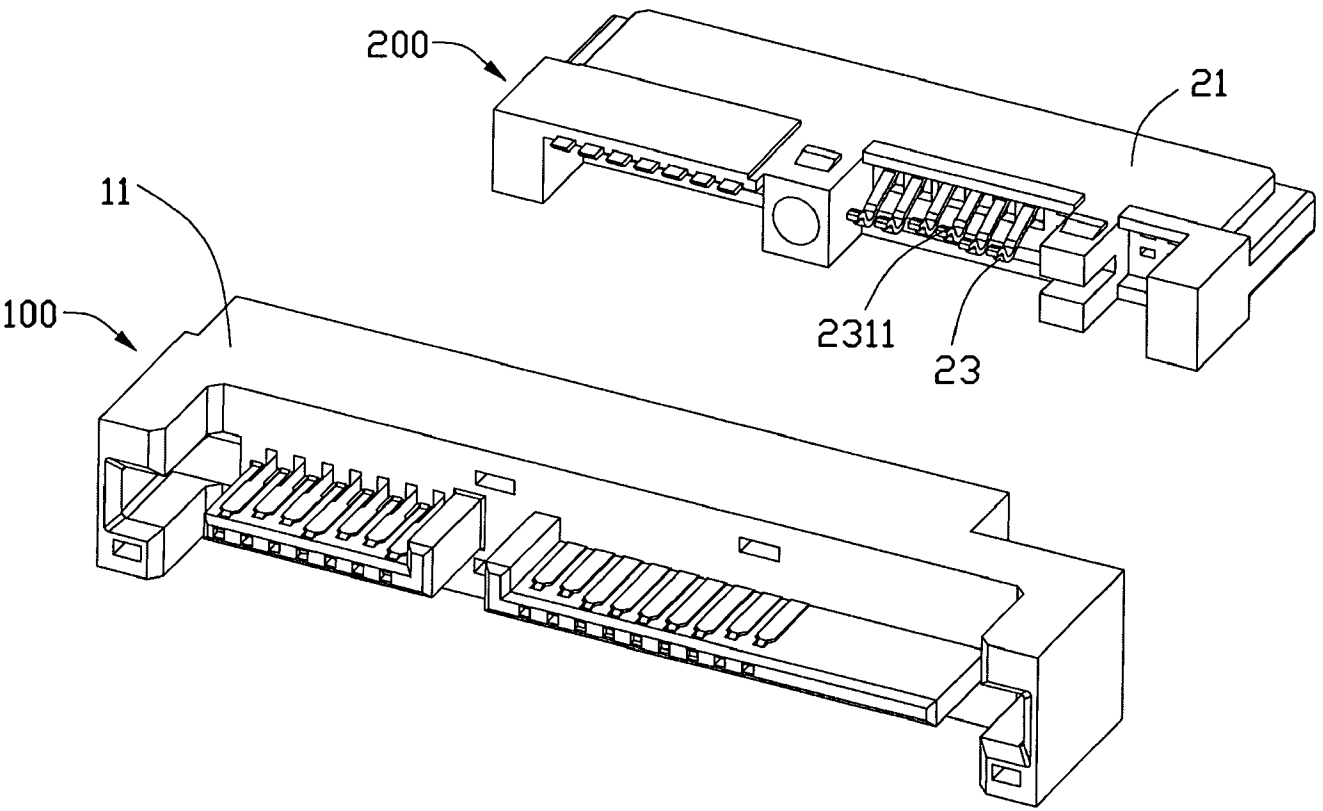
FIG. 2 is an exploded, perspective view of the electrical adaptor of FIG. 1 with two insulating bases separated.

Reference will now be made to the drawing figures to describe the present invention in detail.

Referring to FIGS. 1-5, an electrical adaptor 300 in accordance with a preferred embodiment of the present invention includes a first connector body 100 having a first insulating base 11 and a plurality of first terminals 13 assembled in the first insulating base 11, and a second connector body 200 having a second insulating base 21 and a plurality of second terminals 23 assembled in the second insulating base 21. The first connector body 100 is formed with a first mating port which is defined as a SATA port, the second connector body 200 is formed with a second mating port which is defined as a Micro SATA port opposite to the first mating port. The two connector bodies 100,200 are separate from each other and assembled together to form the electrical adaptor structure with two opposite mating ports to engage with two counter connectors, such as two cable connectors or two backplane connectors to complete signal conversion.

To best understand the design of this embodiment of the present invention, a comparison of pin definition between standard SATA and Micro SATA which can find in SATA Revision 2.6 Specification is shown in FIG. 6. The standard SATA interface includes a set of signal sequence S1-S7 and a set of power sequence P1-P15. The signal sequence comprises two pairs of differential terminals S2-S3,S5-S6 and three grounding terminals S1, S4, S7 for separating the differential terminal pairs, and the power sequence comprises three groups of terminals P1-P3, P7-P9, P13-P15 for providing different voltages and two groups of grounding terminals P4-P6, P10-P12. As Micro SATA interface is an adjusted version of SATA interface during miniaturization, it has consistent signal sequence as SATA interface and mainly omits a whole group of 12V power terminals P13-P15 and part terminals of the other groups. In addition, not all terminals that having the same function between these two interfaces are aligned due to different sizes of interface definition. Detail adapting structure with these two interfaces will be described as below.

Figure 3:
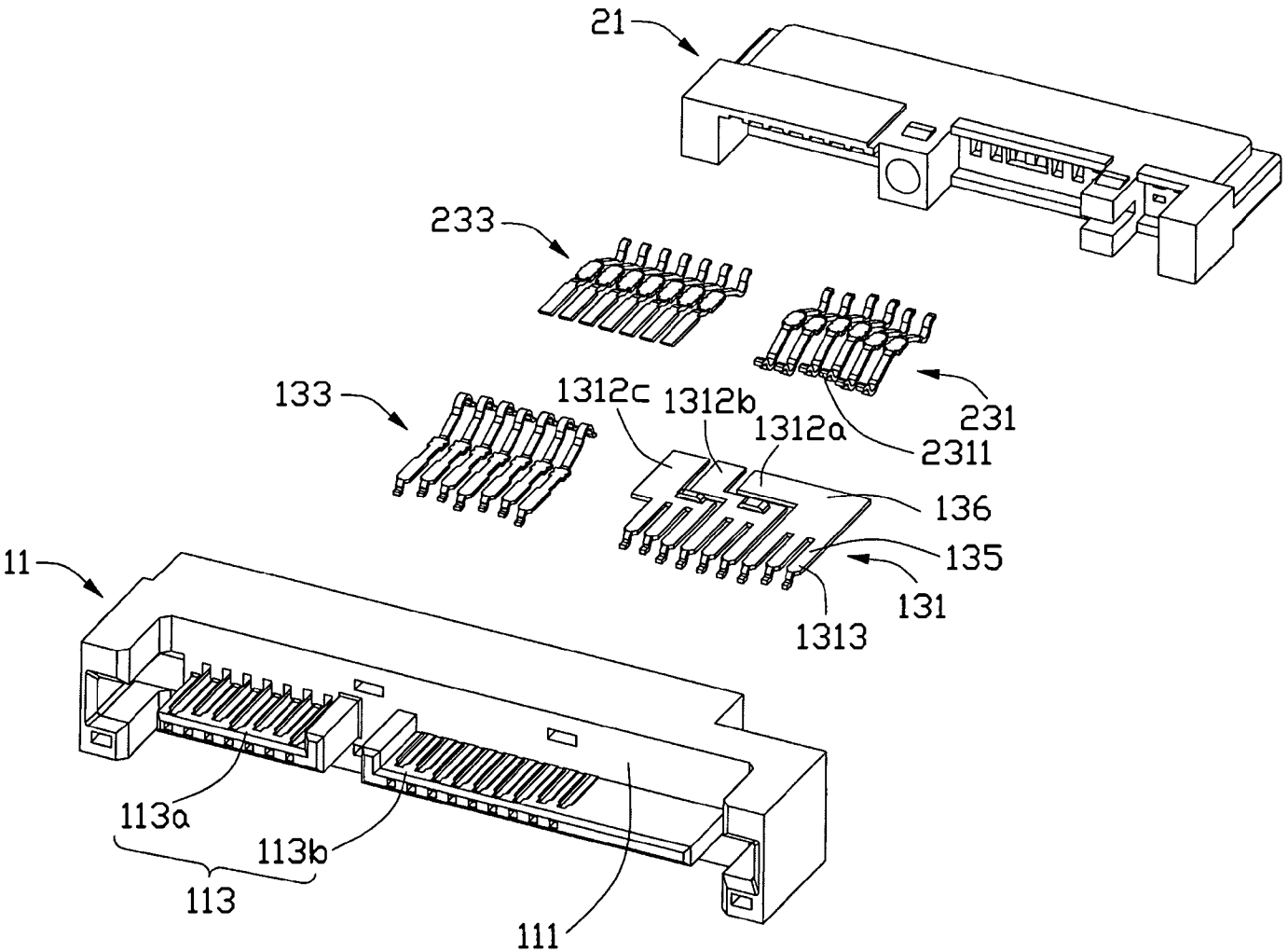
FIG. 3 is a further exploded, perspective view of the electrical adaptor of FIG. 2 with two groups of terminals separated.
Figure 4:
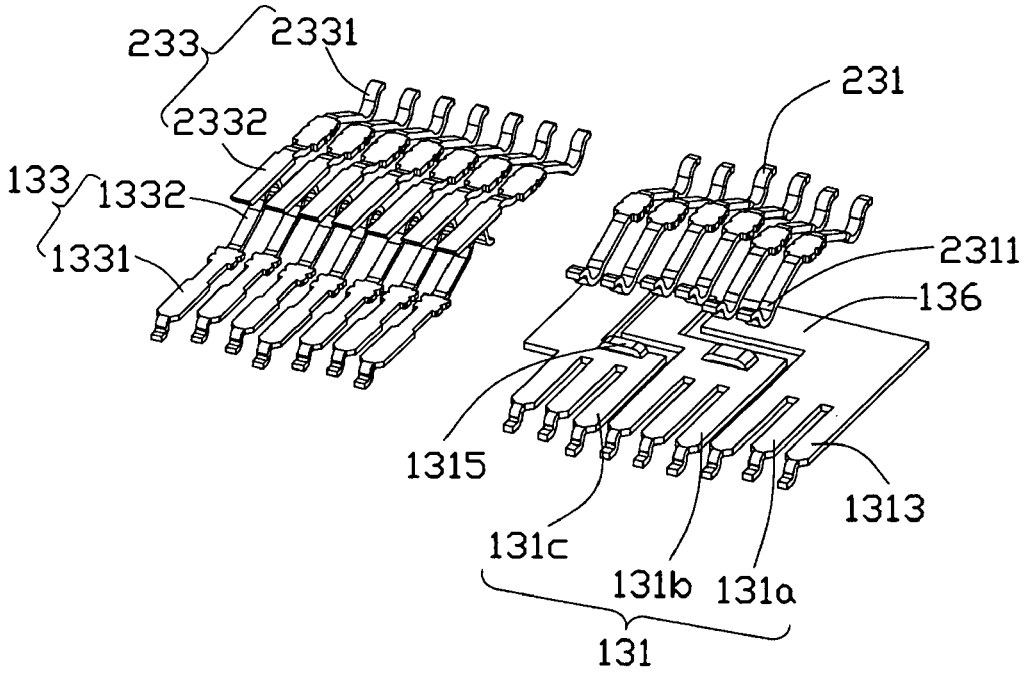
FIG. 4 is a perspective view of the two groups of terminals of FIG. 3.
Figure 5:
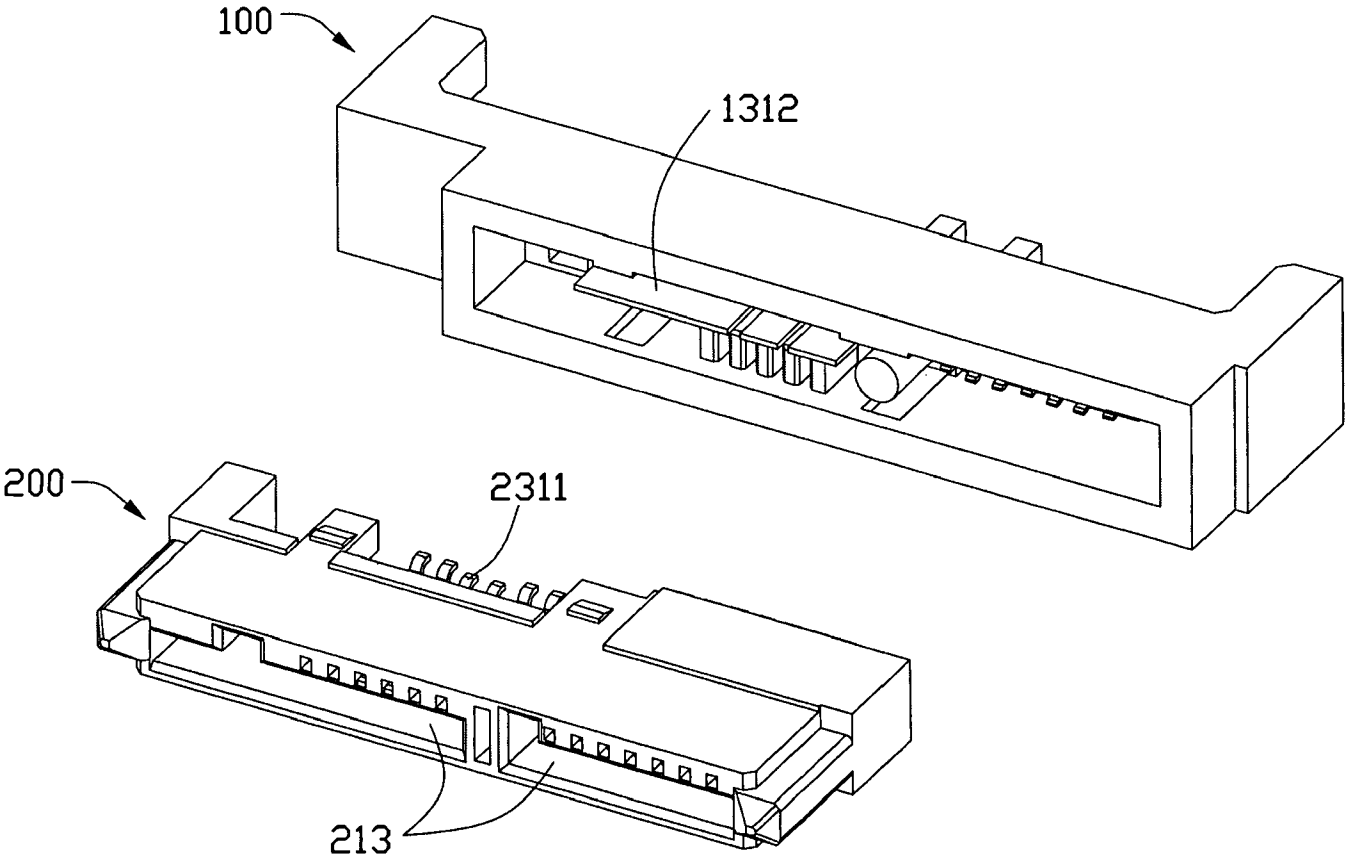
FIG. 5 is an exploded, perspective view of the electrical adaptor of FIG. 1 with two insulating bases separated from another view.

Referring to FIGS. 3-5, the first insulating base 11 comprises two tongue portions 113 extending from a front face of a base portion 111. Said first terminals 13 are divided to two groups, a first group 131 of the first terminals 13 is used for power segment and includes three piece terminals 131*a*, 131*b*, 131*c* and a second group 133 of the first terminals is used for signal segment and includes seven signal slim terminals 133 respectively assembled to the two tongue portions 113*a*, 113*b*. The second insulating base 21 comprises two mating slots 213 corresponding to said two tongue portions 113 and recessed from a front face thereof. Said second terminals 23 are respectively assembled to explode to the two mating slots 213 and comprises a first group 231 with six slim terminals for electrically connecting with the first group 131 of the first terminals and a second group 233 includes corresponding seven slim terminals for electrically connecting the second group 133 of the first terminals.

As best shown in FIGS. 3 and 4, each of the piece terminals 131 of the first terminals 13 is formed by plate-stamping and includes three contacting strips 1313, which are formed by spitting a front ends 135 thereof, thereby nine contacting strips 1313 of said three piece terminals 131*a*, 131*b*, 131*c* just meeting the contact definition of SATA. Each piece terminal 131 defines one touching portion 1312 at a rear end 136 thereof, which is adapted for touching with corresponding two spring portions 2311 of two terminals of the first group 231 of the second connector body 200. Since the dimension of the nine contacting strip 1313 is larger than that of the six touching portions 2311, the touching portions 1312*a*, 1312*b*, 1312*c* of the first group 131 of the first connector body shift to the second group 133 of the first terminals, i.e. the left-hand side of the drawing sheet. In this embodiment, the rear end 136 of the rightmost piece terminal 131*a* is substantially perpendicular to the front end 135 and the distal end of the rear end 136 offsetting from the contact strip 1313 is provided as touching portion 1312*a*, i.e. the touch portion 1312*a* is located behind the contact strip 1313 of the second piece terminals 131*b*. The touching portion 1312*b* is located substantially behind the contacting strips of the left-hand side piece terminal 131*c*. A projection 1315 is protruded on the plate face during plate-stamping process to make firm engagement with the first insulating base 11.

To the power sequence connection of this adaptor, the contacting strips 1313 of the first connector body 100 are disposed on the tongue portion 113*b* to meet SATA interface and the spring portions 2311 of the second connector body 200 are disposed on the mating slot 213 to meet Micro SATA interface. The touching portions 1312 explode to a back face of the base portion 111 for touching corresponding two spring portions 2311 exploding to a back face of the second insulating base 21. To the signal sequence connection of this adaptor, flat contacting portions 1331 are disposed on the tongue portion 113*a* and spring contact portions 2331 are disposed on the mating slot 213 opposite to the flat contacting portions 1331. Another spring touching sections 1332 of the first connector body 100 and flat touching sections 2332 of the second connector body 200 are touched with each other for electrically connecting the two sequences.

With independent design of the first and second insulating base, the fabrication process of the electrical adaptor 300 can be simplified. Because of the touching portion 1312 formed during plate-stamping, offset of contact arrangement between different interfaces can be well configured; And the whole three touching portion 1312 shows a rectangular plate, which can optimize the contact layout. What's more, the continuous touching portion 1312 can self-adjust the manufacturing variation well so as to obtain a better qualification rate.

Referring to FIG. 4 in conjunction with FIG. 6, like short board effect, an adaptor's performance depends on its weakest interface. As to this embodiment, the terminal group P10-P15 of the first connector body 100 and P7-P9 of the second connector body 200 are invalid and not necessary in this SATA-Micro SASA adaptor. Our improvement of omitting them but retain the dimension of tongue portion of both standards can not only ensure the function, but also improve the efficiency and lower the cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adaptor, comprising:

a first connector body loaded with first terminals and a second connector body loaded with second terminals;

said two connector bodies assembly attached with each other and each defining a mating port opposite to each other;

at least some of the first terminals comprising a contacting strip in the mating port of the first connector body and a touching portion;

each second terminal comprising a contacting portion in the mating port of the second connector body and a touching portion;

wherein each touching portion of said some of the first terminals contacts with touching portions of two or more said second terminals; and wherein the some of the first terminals comprises three adjacent first, second and third piece terminals and each piece terminal comprises three contacting strips and one touching portion, wherein each contacting strips are extending into the mating port of the first connector body; wherein the touching portion of the first piece terminal is located behind the contact strip of the second piece terminal and the touching portion of the second piece terminals is located behind the contact strip of the third piece terminal.

2. The electrical adaptor as claimed in claim 1, wherein the touching portion of the first piece terminal is substantially perpendicular to the front end and the distal end of the contact strip and is provided as the touching portion.

3. The electrical adaptor as claimed in claim 2, wherein both of the mating portion and the touching portion of the piece terminals are stamping into plate strips.

4. The electrical adaptor as claimed in claim 2, wherein the first connector body is defined as a SATA connector and the second connector body is defined as a Micro SATA connector.

5. The electrical adaptor as claimed in claim 1, wherein an offset is formed between the touching portion and the contacting portion of the first terminals along mating direction to shift the touching portion of the first terminals align with the layout of touching portions of two or more said second terminals.

6. The electrical adaptor as claimed in claim 5, wherein the first terminal of the first connector body further comprises a mating portion, the touching portion is shifted to match the layout of the two or more second terminals.

7. The electrical adaptor as claimed in claim 6, wherein both of the mating portion and the touching portion of the first terminal are stamping into plate strips.

8. The electrical adaptor as claimed in claim 7, wherein two or more contacting strips are formed on front end of the mating portion of the first to meet the contact definition of the first connector body.

9. The electrical adaptor as claimed in claim 7, wherein the first connector body is defined as a SATA connector and the second connector body is defined as a Micro SATA connector.

10. An electrical adaptor comprising:

a first connection part defining a first mating interface with at least two spaced mating tongue along a transverse direction;

a second connection part being arranged back to back opposite to the first connection part in a longitudinal direction, which is perpendicular to said transverse direction but parallel to a mating direction, and defining a second mating interface with at least two spaced mating cavities along said transverse direction;

a plurality of sets of first terminals retained in the first connection part and corresponding to both said two mating tongues, some of said first terminals defining a front stiff type mating section exposed upon the corresponding mating tongue, and a rear coupling section behind the stiff type mating section; and a plurality of sets of second terminals retained in the second connection part and corresponding to both said two mating cavities, some of said second terminals defining a front resilient type mating portion exposed in the corresponding mating cavity, and a rear coupling portion behind the resilient type mating portion; wherein said coupling sections of the first terminals and said coupling portions of the second terminals are coupled to and complementary with each other under condition that at least either the coupling sections of the first terminals or the coupling portions of the second terminals are resilient for resiliently coupling to the complementary ones, and either some of the coupling sections of the first terminals or some of the coupling portions of the second terminals are unified together as one piece while plural complementary ones are commonly coupled to said unified one; and wherein unified regions of said plurality sets of first terminals are located different depths in said longitudinal direction.

11. The electrical adaptor as claimed in claim 10, wherein the coupling sections of the first terminals are resilient while the coupling portions of the second terminals are stiff.

12. The electrical adaptor as claimed in claim 10, wherein the first connection part defines a first insulative body holding the first terminals therein, the second connection part defines a second insulative body holding the second terminals therein, and the first insulative body is assembled to the first insulative body.

13. The electrical adaptor as claimed in claim 10, wherein some of the coupling sections of the first terminals are unified as one piece.

14. The electrical adaptor as claimed in claim 13, wherein there are plural sets of first terminals define plural unified coupling sections.

15. The electrical adaptor as claimed in claim 14, wherein the mating sections of said plural sets of first terminals are all disposed upon the same mating tongue.

* * * * *